US005518561A

United States Patent [19]

Rosa

[11] Patent Number: 5,518,561

[45] Date of Patent: May 21, 1996

[54] TRUE COLOR DAY-NIGHT GRAPHICS AND METHOD OF ASSEMBLY

[76] Inventor: Stephen P. Rosa, 12213 Mt. Albert Rd., Ellicott City, Md. 21042

[21] Appl. No.: 417,535

[22] Filed: Apr. 6, 1995

Related U.S. Application Data

[63] Continuation of Ser. No. 125,882, Sep. 24, 1993, abandoned.

[51] Int. Cl.[6] ..... G09F 13/22

[52] U.S. Cl. ..... 156/71; 156/277; 40/544; 40/591; 40/594

[58] Field of Search ..... 156/60, 71, 277; 40/542, 544, 591, 594; 362/84

[56] References Cited

U.S. PATENT DOCUMENTS

| | | | |
|---|---|---|---|
| H1488 | 9/1995 | Campagnuolo et al. | 342/45 |
| 3,068,376 | 12/1962 | Hammell et al. | 313/498 |
| 3,161,797 | 12/1964 | Butler et al. | 313/512 |
| 4,020,389 | 4/1977 | Dickson et al. | 315/246 |
| 4,066,925 | 1/1978 | Dickson | 313/503 |
| 4,138,620 | 2/1979 | Dickson | 313/1 |
| 4,494,326 | 1/1985 | Kanamori | 40/593 |
| 5,005,306 | 4/1991 | Kinstler | 40/591 |
| 5,144,328 | 9/1992 | Blake et al. | 347/101 |
| 5,471,773 | 12/1995 | Hoffman | 40/544 |

*Primary Examiner*—David A. Simmons
*Assistant Examiner*—J. Sells

[57] ABSTRACT

A flexible true color day-night graphic display particularly suited to providing high color quality graphics during both day and night on the sides of commercial vehicles includes an image-carrying translucent flexible substrate, a flexible electroluminescent lamp and a durable flexible optically transparent adhesive. The display is flexibly adhered to the sidewalls of cargo trailers or other support surfaces and supplied at night with electrical current to energize the light-emitting electroluminescent panel. The night visible graphics not only satisfy advertising demands for color fidelity without compromising daytime effectiveness, but also increase the overall visibility of the graphic-carrying vehicle to enhance highway safety.

7 Claims, 2 Drawing Sheets

FIG. 1
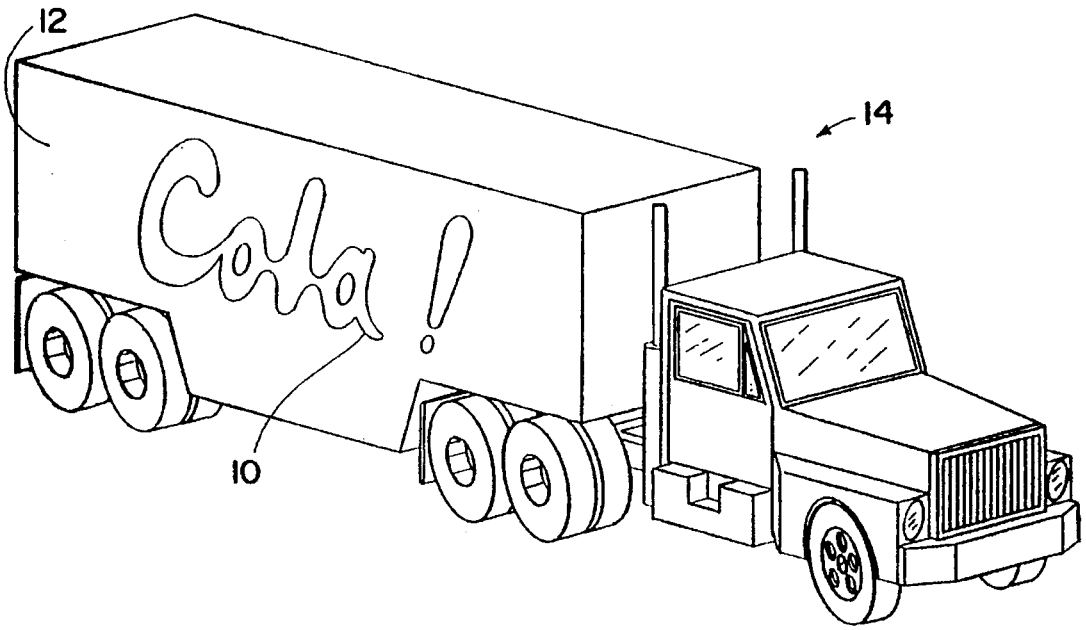
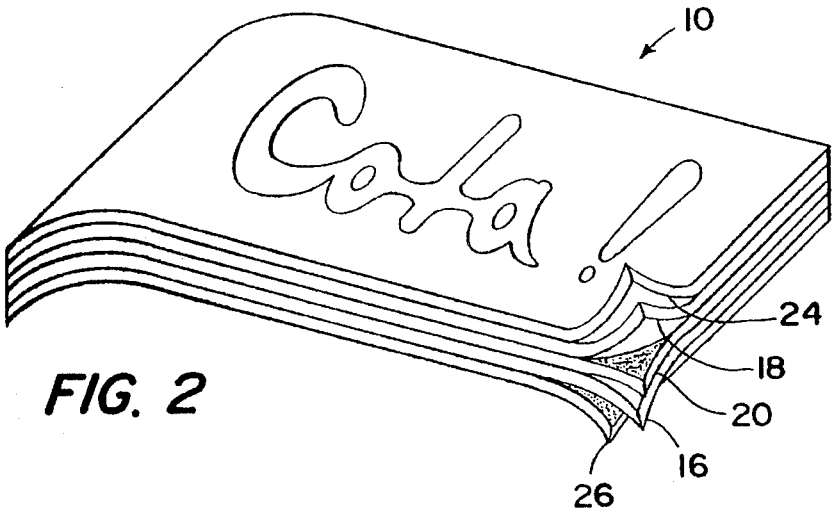
FIG. 2

TRUE COLOR DAY-NIGHT GRAPHICS AND METHOD OF ASSEMBLY

This is a continuation of U.S. patent application Ser. No. 08/125,882, filed Sep. 24, 1993, abandoned.

BACKGROUND OF THE INVENTION

1. Field of the Invention

The present invention pertains to graphic displays and, more particularly, to conformable true color graphic displays fully visible in both front and back light.

2. Discussion of the Prior Art

Color graphics for daylight or front lighting applications are created by layering pigment inks on opaque white substrate. Color graphics for dramatic nighttime back lighting are produced by applying pigment inks to translucent substrate. Front lighting produces images that result from light that passes through the ink, is reflected by the opaque substrate and passes back through the ink to the observer, while back lighting images result from light that passes through the translucent substrate, then through the ink and on to the observer. As a result, front lighting images transit the inked layer twice and back lighting images transit the inked layer once so that back lit graphics must be considerably more heavily pigmented in order to obtain the same spectral content or color fidelity as front lit graphic displays. Consequently graphics capable of faithfully producing back lit colors appear dark and inaccurate when viewed by front light. Advertising frequently demands exact colors in all viewing situations, especially where logos are characterized as much by color as by shape, and the color distortion associated with daylight viewing of traditionally produced back lighting graphics is not acceptable. In addition, the mechanics of providing uniform fluorescent or incandescent light for even moderately sized back lit color graphics has been discouragingly difficult, costly and space consuming. Advertisers have been faced with the choice between accepting the seriously degraded visual presentation prior art back lighting produces in daylight or forfeiting the desirable eye catching effects they produce at night.

The moving billboard advertising opportunity presented by the sides of cargo trailers is illustrative of the prior art dilemma. Vivid commercial art generally adorns the daylight observation of these prime advertising surfaces, but after dark the value of the space is lost or compromised by typically weak and unpredictable front lighting from external sources or side lighting attached to the truck trailer. Protruding front lighting schemes mounted to the truck present the added disadvantage of being damaged when the trailer is being moved in the close spaces typical of loading terminals, and adds to wind resistance, thereby increasing fuel consumption and cost.

A new method for producing color graphics presenting essentially the same spectral content when illuminated by front lighting or by back lighting, a quality termed "transflectivity", has been disclosed and claimed in U.S. Pat. No. 5,144,328 (Blake et al), and is incorporated herein by reference. In this process nearly identical graphic images are inked onto each side of a translucent substrate in full registry, that is, in complete alignment with each other. Daylight or front lighting passes through the inked image on the front side of the substrate, and is reflected by the substrate back through the image to the viewer, passing through the front ink image twice. Back lighting the same graphic results in light passing through the inked image on the back side of the substrate, through the substrate, then through the image on the front side and on to the viewer, resulting in two passages through two identical ink images. The viewer is presented in each case with an image produced by light having been acted upon by two thicknesses of ink and thus the same spectral content or, color fidelity, is achieved by both lighting arrangements. Where substantial differences exist in the spectral content of the front light source and the back light source, compensations can be made in the pigmentation concentrations used on the back surface without altering the colors viewed with front lighting.

Advances in electroluminescent technology have resulted in the development of efficient flexible planar lamps having finely divided electroluminescent phosphor embedded in a layer of light transmitting resin bonded between a non-transparent electrode layer and a substantially transparent electrode layer. An example of such a lamp is disclosed and claimed in U.S. Pat. No. 4,020,389 (Dickson et al), incorporated herein by reference. Such lamps can be fabricated into large thin sheets having a bending radius on the order of 0.5 inches for a 180° turn, capable of being cut into a variety of shapes and sealable against weather effects. The lamps produce light of uniform intensity in the 7 to 25 foot-lamberts per square inch range over the entire surface and require modest levels of alternating current.

U.S. Pat. No. 4,138,620 (Dickson) teaches overlapping electroluminescent panels on a relatively stiff support plate within an aluminum frame to provide large areas of uniform illumination, overlaying such panels with fluorescent pigment graphics, and maintaining registration or alignment between the graphics and the electrolumenescent panels. These panels are relatively heavy, are difficult to mount and install and increase vehicle wind resistance; accordingly, they have not found commercial acceptance for vehicle advertising applications.

There exists in the prior art a long felt need for practical true color day-night graphic displays commercially suitable for use on irregularly contoured and soft-sided vehicle sides and ends.

SUMMARY OF THE INVENTION

Accordingly, it is a primary object of the present invention to overcome the above mentioned disadvantages of the prior art by providing a rugged, conformable, lightweight and formable graphical display, especially suitable for conformably mounting on the surfaces of vehicles, to present an observer with the same visibility and color fidelity when viewed front lit in daytime and back lit during the night.

Another object of the present invention is to provide a full color message medium suitable for twenty-four hour a day communication with true and constant color.

A further object of the present invention is to provide thin flexible day-night advertising panels that are formable into any desired shape, adhered easily to irregular surfaces and are weather resistant.

Yet another object of the present invention is to provide economic and dramatic nighttime graphics panels for use on the sides of vehicles to present desired messages and to enhance the visibility and consequently the road safety of such vehicles.

A still further object of the present invention is to flexibly bond electroluminescent panels to graphic image-carrying substrate with essentially transparent adhesive to produce durable flexible thin true color day-night advertising panels.

Some of the advantages of the present invention over the prior art are that: all of the essential elements of graphic display are presented equally whether viewed with reflected daylight or seen back lit at night using the same display space rather than allocating a portion of the space to dedicated daylight advertising and a separate portion to dedicated back lit advertising; and the display can be made to conform to a wide range of shapes, requires a relatively small amount of energy, can be easily applied to most surfaces, is weather resistant and can be economically produced.

The present invention is generally characterized by a graphic display having a flexible electroluminescent panel conformably bondable on the non-luminescent side to any desired surface and bonded with a durable flexible optically clear and essentially transparent adhesive on the luminescent side to a graphic image-carrying translucent film having nearly identical images inked in registry on both sides to produce spectrally similar images in both reflected and back light.

Other objects and advantages of the present invention will become apparent from the following description of the preferred embodiment taken in conjunction with the accompanying drawings wherein like parts in each of the several figures are identified by the same reference characters.

BRIEF DESCRIPTION OF THE DRAWINGS

FIG. 1 is a perspective view of a cargo trailer having a true color day-night graphic display panel according to the present invention mounted on the side.

FIG. 2 is a partially delaminated perspective view of the layered sandwich construction of the true color day-night graphic display panel of the present invention.

DESCRIPTION OF THE PREFERRED EMBODIMENT

Figure 3:
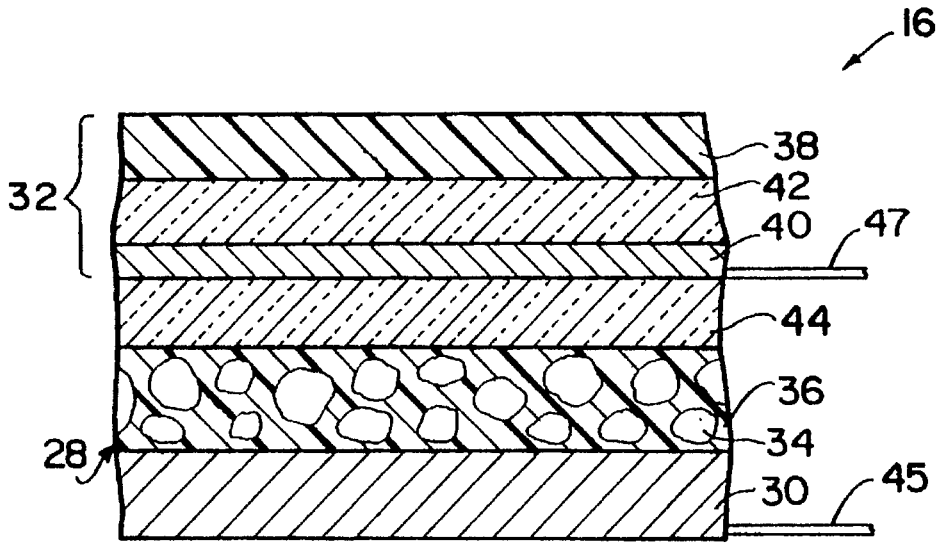
FIG. 3 is a cross-section of an electroluminescent lamp for use in the present invention.

A true color day-night graphic display panel 10 is shown attached to and flexibly conforming to the side 12 of cargo trailer 14 in FIG. 1. The panel 10 shown in FIG. 2 includes three major elements: a flexible planar electroluminescent lamp 16 similar in characteristics to the lamp disclosed by Dickson et al in U.S. Pat. No. 4,020,389; a translucent image-carrying film-like substrate 18 capable of producing spectrally similar images with front and back illumination as taught by Blake et al in U.S. Pat. No. 5,144,328; and an optically clear flexible adhesive 20, as for instance, marketed by Morgan Adhesives Company of Stow, Ohio under the name PERMATRANS™ IP-2100 to adhere the image-carrying substrate to the lamp. An additional protective layer of weather and wear resistant essentially transparent material 24 can be used to enclose and protect the graphic display panel and conventional means such as a layer of flexible adhesive 26 (e.g., 3M Controltac™ 180 series produced by the 3M Corporation of St. Paul, Minn.) may be used to attach the graphic display to selected support surfaces.

The electroluminescent lamp 16 shown in FIG. 3 may, for example, be of the type disclosed in the aforementioned Dickson et al patent. Lamp 16 has a thin flexible conformable sandwich construction including a layer of electroluminescent material 28 bonded between a conventional opaque electrode layer 30 on the opaque side and an essentially transparent electrode layer 32 on the light-emitting side. The electroluminescent material can consist of fine particles 34 of an electroluminescent phosphor embedded in a transparent flexible resin 36. The transparent electrode layer 32 is formed of a transparent polymeric substrate 38 of, for example, polyethylene terethphalate, having a high degree of optical transparency, bonded to a metal film 40 sandwiched between layers of high refraction index dielectric films 42 and 44.

Contacts 45 and 47 are fitted to the opaque electrode 30 and the metal thin-film layer 40, respectively, in a conventional manner to energize the lamp with a high frequency alternating current source.

Figure 4:
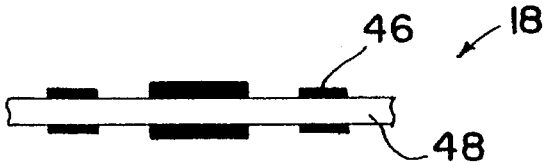
FIG. 4 is a cross-section of an image-carrying substrate with inked graphics in registry on each side.

The image-carrying substrate 18 shown in FIG. 4 may, for example, be of the type disclosed in the aforementioned Blake et al patent and has essentially identical inked images 46 deposited in registry on the two sides of a very flexible translucent substrate 48. In practice, the translucent substrate has a transmission factor of approximately 15% and a reflectance of about 85% and may be vinyl material. In an alternative embodiment of the true color day night graphic display, the inked images may be carried in registry on two optically neutral substrates, a translucent substrate and a transparent substrate. The translucent substrate is bonded with optically transparent adhesive to the transparent substrate bonded in turn to the light emitting face of the electroluminescent panel. The effect is the same. Light from the front of the display is reflected by translucent substrate after twice transitting the inked images on that surface. Light from the back, emitted by the electroluminescent lamp, passes through the inked images affixed to transparent substrate and then passes through the inked images on translucent substrate to also reach the observer after being twice affected by passage through the inked images.

In a further modification the translucent substrate is replaced by a layer of white translucent colorant applied directly over the surface of the transparent substrate and the images inked thereon, again with the same result.

The adhesive 20 must dry essentially transparent, i.e. having an optical clarity of 90% or more, and cannot discolor with age as this would compromise the spectral quality of the graphic images when viewed back lit by the electroluminescent panel. The transmissivity to white light of the aforementioned PERMATRANS™ IP-2100 is specified as 98% that of laboratory glass but adhesives having lower values of transmissivity could also be used depending on the intensity of the electroluminescent lamp and the brightness requirements of the overall application. In addition, the adhesive must be flexible enough to conform with lamp 16 and substrate 18 to contoured surface applications of the present invention without loss of adhesive bonding properties. Further, the adhesive must not destructively interact with the inked graphics nor penetrate through the substrate. Finally, the adhesive must perform reliably despite constant vibration and fluctuating extremes of temperature and moisture. The PERMATRANS™ IP-2100 product, a thin clear polyester film coated on both sides with clear acrylic pressure sensitive adhesive, and a flowable liquid adhesive marketed by the 3M Corporation of St. Paul, Minn. under the name Scotch-Grip™ 4475, both satisfy the demands of this application.

Achieving optimal color reproduction, in view of variations in the pigmentation of inks and the spectral content of front and back lighting sources, may require some differences in the exact composition and thickness of the images 46 inked essentially in registry. The large scale color graphic systems used to produce outdoor advertising, particularly the computer controlled techniques common in the prior art, are well suited to make such accommodations, and alternative approaches for producing thin film graphics with essentially similar back and front lighting spectral content are envisioned as within the scope of this invention.

All elements 16, 18, 20, 24 and 26 of the display panel 10 are flexible and the panel can be formed to fit and closely follow, or conform to the contours of any selected surface, for example the recessed, rippled, ribbed, riveted or corrugated sides of rigid sided cargo trailers, train cars and other vehicles. For this purpose the display panel must be capable of bends of at least 90° without destroying the adhesive bonds, reducing the optical transmission characteristics, or destroying light emission characteristics of the electroluminescent panel. A bending radius of 0.5 inches for a 180° turn, considered a reasonable characteristic for EL panel construction, is fully compatible with this application and both the translucent substrate and transparent adhesive conform to this required level of flexibility. The display panel may be conformably bonded to fabric sidewalls of other such vehicles, or may extend around right angle bends between side and rear walls of a vehicle.

Manual or photocell activation of the electric power source energizes the electroluminescent lamp to back light the graphic image. Power can be drawn from the vehicle electric system or independently produced by a dedicated generator, storage battery system or solar cell means. When energized by the presence lights or running lights of cargo trailers, the visual effects of such electroluminescence enhances the observability and consequently the highway safety of such vehicles.

Figure 5:
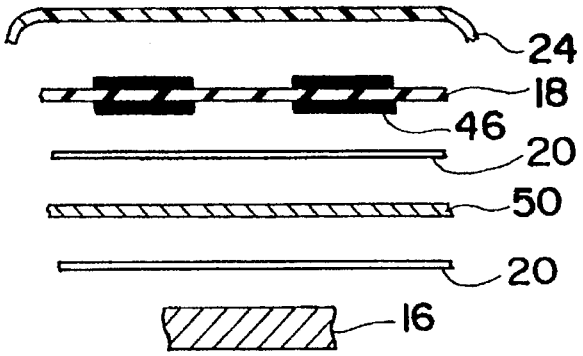
FIG. 5 is a cross-section of the present invention with a light diffuser interposed between the image-carrying substrate and the electroluminescent lamp.

Continuous sheet electrodes allow the true color day-night graphic panels to be cut to any desired shape. For example, the electroluminescent lamp material may be contoured to back only specific lettering, figures or other features. Moreover, multiple power source circuits may be used to permit various portions of the panels to provide different levels of illumination or even, through conventional circuitry, to provide intermittent or blinking portions for further dramatic effect. As shown in FIG. 5, a sheet of light-diffusing material 50 of various designs, as for instance Lensfilm, a polymethyl methacrylate blend marketed by the 3M Corporation of St. Paul, Minn., conventional in the art, can be interposed between the electroluminescent lamp 16 and the image carrying substrate 18 to improve the uniformity of illumination over the panel or to reduce the lamp area required to illuminate the image-carrying substrate.

Inasmuch as the present invention is subject to many variations, modifications and changes in detail, it is intended that the subject matter discussed above and shown in the accompanying drawings be interpreted as illustrative and not in a limiting sense.

What is claimed is:

1. A method for producing conformable true color day-night graphic displays for conformable attachment to the predetermined topographical features forming the exterior surfaces of commercial vehicles, said displays having substantially equivalent spectral content when illuminated by a light source located in front of the display as when illuminated by a light source located behind the display, said method comprising the steps of:

(a) applying a first set of inked graphic images on the front face of a flexible translucent substrate;

(b) applying a second set of inked graphic images on the back face of said translucent substrate in registry with said first set of inked graphic images;

(c) adhering said back face of said translucent substrate to the light-emitting face of a flexible electroluminescent panel with a durable conformable essentially transparent adhesive material to form a substrate-panel assembly;

(d) adhering the non-light emitting face of said electroluminescent panel to said vehicle side such that said substrate-panel assembly conforms to the topographical features of the commercial vehicle; and (e) applying electrical energy to energize said electroluminescent panel.

2. The method of claim 1 wherein step (e) includes applying said electrical energy from a running light circuit of said vehicle.

3. The method of claim 1 wherein step (e) comprises applying said electrical energy from a presence light circuit of said vehicle.

4. A method for producing a graphic display panel conformable to predetermined topographical features of exterior surfaces of commercial vehicles, said graphic display panels having similar visual characteristics day and night using a conformable translucent substrate having a front and a rear surface, each of said surfaces having inked images disposed in registry and a conformable electroluminescent panel with means to be activated by electrical current at night, said method comprising the step of adhering said substrate to said electroluminescent panel with a durable conformable, essentially transparent adhesive to form a conformable substrate-panel assembly to permit said assembly to conform to said typographical features.

5. The method as recited in claim 4 further comprising the step of enclosing said display panel in an essentially conformable transparent weather and wear-resistant protective layer.

6. The method as recited in claim 4 further comprising the step of bonding said display panel to the surface of a vehicle.

7. A method for producing a true color day-night graphic display conformable to the predetermined topographical features of the exterior surfaces of commercial vehicles, said method comprising the steps of bonding an image-carrying substrate having the property of producing high fidelity full color graphics in both front and back lighting environments to a conformable electroluminescent panel with an optically transparent and conformable adhesive to form a substrate-panel assembly, contouring and conforming said graphic display to an exterior surface of a vehicle having said predetermined topographical features, and energizing said panel to produce back lighting for said graphic display at night.

* * * * *